US006739690B1

(12) United States Patent
Darling

(10) Patent No.: US 6,739,690 B1
(45) Date of Patent: May 25, 2004

(54) INK JET APPARATUS

(75) Inventor: Douglas D. Darling, Portland, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/365,117

(22) Filed: Feb. 11, 2003

(51) Int. Cl.[7] ..... B41J 29/393; B41J 29/38; B41J 2/175

(52) U.S. Cl. ..... 347/19; 347/10; 347/11; 347/88

(58) Field of Search ..... 347/10, 11, 88

(56) References Cited

U.S. PATENT DOCUMENTS 5,736,993 A 4/1998 Regimbal et al. ..... 347/11
6,217,141 B1 * 4/2001 Nakamura et al. ..... 347/10
6,305,773 B1 10/2001 Burr et al. ..... 347/11
6,312,080 B1 * 11/2001 De Roos et al. ..... 347/14
6,354,686 B1 * 3/2002 Tanaka et al. ..... 347/11
6,598,950 B1 * 7/2003 Hosono et al. ..... 347/11
2001/0022596 A1 9/2001 Korol ..... 347/10

* cited by examiner

*Primary Examiner*—Russell Adams
*Assistant Examiner*—Alfred E Dudding
(74) *Attorney, Agent, or Firm*—Manuel Quiogue

(57) ABSTRACT

A drop emitting device that includes a drop generator and a drive signal waveform that includes in sequence a first negative pulse, a positive pulse and a second negative pulse.

22 Claims, 3 Drawing Sheets

INK JET APPARATUS

BACKGROUND OF THE DISCLOSURE

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

A known ink jet drop generator structure employs an electromechanical transducer to displace ink from an ink chamber into a drop forming outlet passage, and it can be difficult to control drop velocity and/or drop mass.

DETAILED DESCRIPTION OF THE DISCLOSURE

Figure 1:
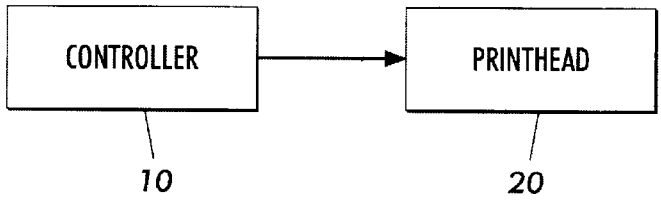
FIG. 1 is a schematic block diagram of an embodiment of a drop-on-demand drop emitting apparatus.

FIG. 1 is schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
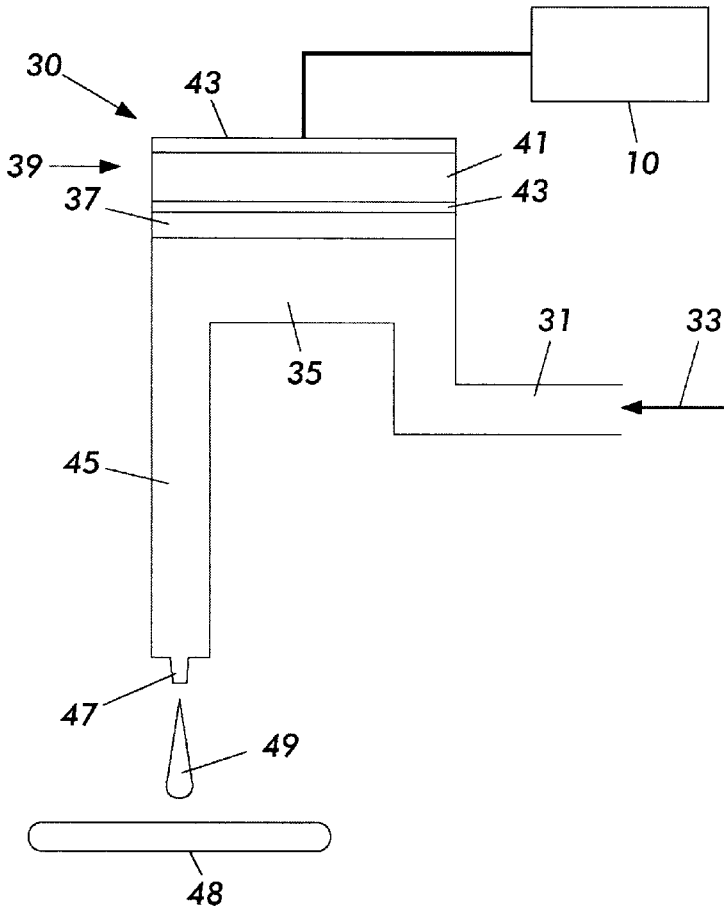
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface, for example. The outlet channel 45 can include a nozzle or orifice 47.

The ink 33 can be melted or phase changed solid ink, and the electromechanical transducer 39 can be a piezoelectric transducer that is operated in a bending mode, for example.

Figure 3:
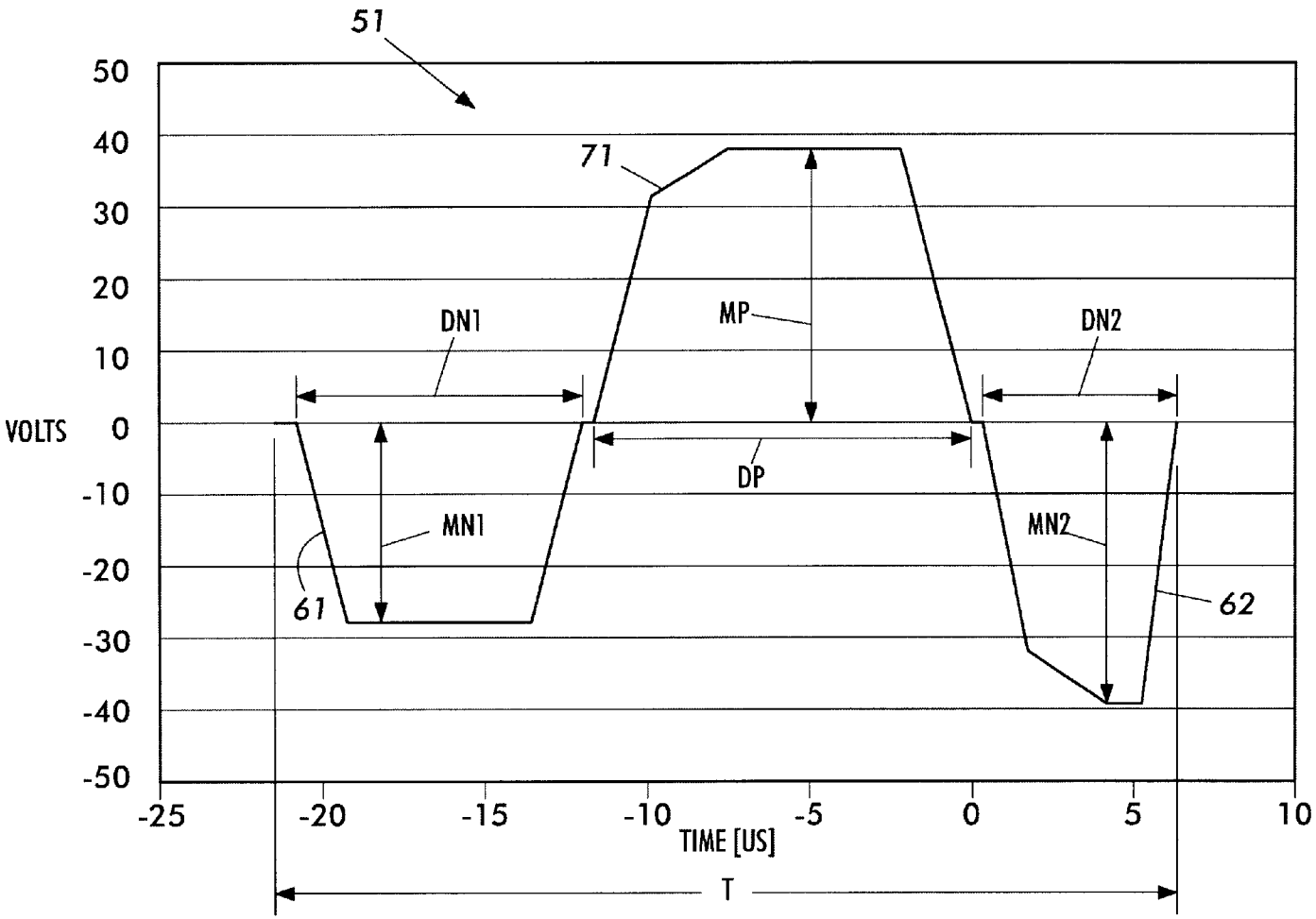
FIG. 3 is a schematic depiction of an embodiment of a drive signal that can be employed to drive the drop generator of FIG. 2.
Figure 4:
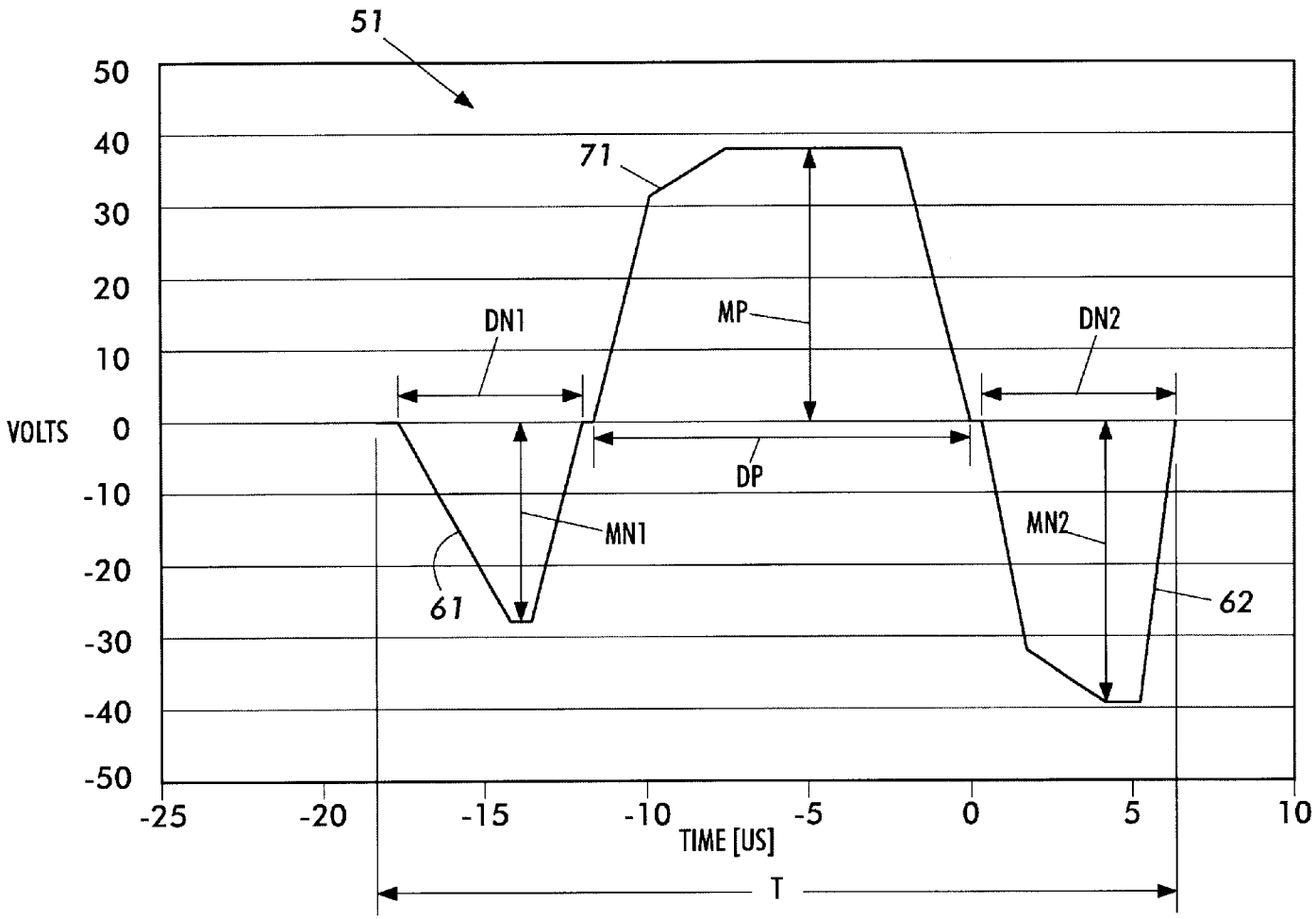
FIG. 4 is a schematic depiction of another embodiment of a drive signal that can be employed to drive the drop generator of FIG. 2.

FIGS. 3 and 4 are schematic diagrams of embodiments of a drive drop firing signal or waveform 51 that is provided to the printhead during a firing interval T to cause an ink drop to be emitted. The time varying drop firing waveform 51 is shaped or configured to actuate the electromechanical transducer such that the drop generator emits an ink drop. By way of illustrative example, the firing interval T can be in the range of about 56 microseconds to about 28 microseconds, such that the drop generator can be operated in the range of about 18 KHz to about 36 KHz. As another example, the firing interval T can be in the range of about 1000 microseconds to about 28 microseconds, such that the drop generator can be operated in a range of about 1 KHz to about 36 KHz.

By way of illustrative example, the drop firing waveform 51 can be a bi-polar voltage signal having in sequence a first negative pulse component 61, a positive pulse component 71, and a second negative pulse 62 component. The pulses are negative or positive relative to a reference such as zero volts. Each pulse is characterized by a pulse duration DN1, DP, DN2 which for convenience is measured between the pulse transition times (i.e., the transition from the reference and the transition to the reference). Each pulse is also characterized by a peak pulse magnitude MN1, MP, and MN2 which herein is a positive number.

The first negative pulse 61 can have a duration DN1 in the range of about 5 microseconds to about 10 microseconds. The positive pulse 71 can have a duration DP in the range of about 7 microseconds to about 14 microseconds. The second negative pulse 62 can have a duration DN2 in the range of about 3 microseconds to about 8 microseconds. In this manner, the positive pulse 71 can have a duration that is greater than the duration DN1 of the first negative pulse 61 and greater than the duration DN2 of the second negative pulse 62. The duration DN1 of the first negative pulse 61 can be less than or greater than the duration DN2 of the second negative pulse 62. The durations DN1, DN2 of the first and second negative pulses 61, 62 can be similar.

The first negative pulse 61 can have a peak magnitude MN1 in the range of about 20 volts to about 35 volts. For example, the peak magnitude MN1 of the first negative pulse 61 can be less than 30 volts. The positive pulse 71 can have a peak magnitude MP in the range of about 30 volts to about 45 volts. For example, the peak magnitude MP of the positive pulse 71 can be less than about 40 volts. The second negative pulse 62 can have a peak magnitude MN2 that is in the range of about 30 volts to about 45 volts. For example, the peak magnitude MN1 of the first negative pulse 61 can be less than 40 volts. The first negative pulse 61 can have a peak magnitude MN1 that is less than the peak magnitude MP of the positive pulse 71 and is less than the peak magnitude MN2 of the second negative pulse 62.

By way of illustrative examples, the first negative pulse 61 can be generally trapezoidal (FIG. 3) or generally triangular (FIG. 4). Other shapes can be employed.

The first negative pulse component is a pre-pulse that adds energy to the jet, which can reduce the peak magnitude MP of the positive pulse 71 and can reduce the peak magnitude MN2 of the second negative pulse 62. The portion of the positive pulse that has a non-negative slope causes the ink chamber to fill while the negative going portion of the positive pulse causes a drop to be emitted.

The first negative pulse can be timed so that its energy will add constructively with the positive pulse. The magnitude of the first negative pulse is preferably configured such that it does not cause a drop to be emitted. The magnitude of the first negative pulse can also be configured such that it does not cause air to be ingested into the jet.

The invention has been described with reference to disclosed embodiments, and it will be appreciated that variations and modifications can be affected within the spirit and scope of the invention.

What is claimed is:

1. A drop emitting device comprising:

an electromechanical drop generator;

a drop firing waveform applied to the electromechanical drop generator over a drop firing interval; and the drop firing waveform including in sequence a negative pulse having a duration in a range of about 5 microseconds to about 10 microseconds, a positive pulse having a duration in a range of about 7 microseconds to about 14 microseconds, and a negative pulse having a duration in a range of about 5 microseconds to about 8 microseconds.

2. The drop emitting device of claim 1 wherein the first negative pulse has a generally triangular shape.

3. The drop emitting device of claim 1 wherein the first negative pulse has a generally trapezoidal shape.

4. The drop emitting device of claim 1 wherein the first negative pulse has a peak magnitude that is less than about 30 volts.

5. The drop emitting device of claim 1 wherein the positive pulse has a peak magnitude that is less than about 40 volts.

6. The drop emitting device of claim 1 wherein the second negative pulse has a peak magnitude that is less than about 40 volts.

7. The drop emitting device of claim 1 wherein the electromechanical drop generator comprises a piezo transducer.

8. The drop emitting device of claim 1 wherein the electromechanical drop generator includes a transducer that is selected from the group consisting of a shear-mode transducer, an annular constrictive transducer, an electrostrictive transducer, an electromagnetic transducer, and a magnetorestrictive transducer.

9. The drop emitting device of claim 1 wherein the drop firing interval is no greater than about 56 microseconds.

10. The drop emitting device of claim 1 wherein the drop firing interval is in the range of about 28 microseconds to about 56 microseconds.

11. A drop emitting device comprising:

a drop generator;

a drop firing waveform applied to the drop generator over a drop firing interval; and the drop firing waveform including in sequence a first negative pulse, a positive pulse, and a second negative pulse, wherein the first negative pulse has a generally triangular shape.

12. A drop emitting device comprising:

a drop generator;

a drop firing waveform applied to the drop generator over a drop firing interval; and the drop firing waveform including in sequence a first negative pulse, a positive pulse, and a second negative pulse, wherein the first negative pulse has a peak magnitude that is less than about 30 volts.

13. A drop emitting device comprising:

a drop generator;

a drop firing waveform applied to the drop generator over a drop firing interval that is no greater than about 56 microseconds; and the drop firing waveform including in sequence a first negative pulse, a positive pulse, and a second negative pulse.

14. A drop emitting device comprising:

an electromechanical drop generator;

a drop firing waveform applied to the electromechanical drop generator over a drop firing interval; and the drop firing waveform including in sequence a first negative pulse having a peak magnitude that is less than about 30 volts but not less than about 20 volts, a positive pulse having a peak magnitude that is less than about 40 volts but not less than about 35 volts, and a negative pulse having a peak magnitude that is less than about 40 volts but not less than about 35 volts.

15. A drop emitting device comprising:

an electromechanical drop generator;

a drop firing waveform applied to the electromechanical drop generator over a drop firing interval; and the drop firing waveform including in sequence a first negative pulse having a peak magnitude in the range of about 20 volts to about 35 volts, a positive pulse having a peak magnitude in the range of about 35 volts to about 45 volts, and a second negative pulse having a peak magnitude in the range of about 35 volts to about 45 volts, wherein the first negative pulse has a duration that is less than a duration of the positive pulse.

16. A drop emitting device comprising:

an electromechanical drop generator;

a drop firing waveform applied to the electromechanical drop generator over a drop firing interval; and the drop firing waveform including in sequence a first negative pulse having a peak magnitude in the range of about 20 volts to about 35 volts, a positive pulse having a peak magnitude in the range of about 35 volts to about 45 volts, and a second negative pulse having a peak magnitude in the range of about 35 volts to about 45 volts, wherein the first negative pulse has a duration that is less than a duration of the second negative pulse.

17. A drop emitting device comprising:

an electromechanical drop generator;

a drop firing waveform applied to the electromechanical drop generator over a drop firing interval; and the drop firing waveform including in sequence a first negative pulse having a peak magnitude in the range of about 20 volts to about 35 volts, a positive pulse having a peak magnitude in the range of about 35 volts to about 45 volts, and a second negative pulse having a peak magnitude in the range of about 35 volts to about 45 volts, wherein the first negative pulse has a generally triangular shape.

18. A drop emitting device comprising:

an electromechanical drop generator;

a drop firing waveform applied to the electromechanical drop generator over a drop firing interval that is no greater than about 56 microseconds; and the drop firing waveform including in sequence a negative pulse having a peak magnitude in the range of about 20 volts to about 35 volts, a positive pulse having a peak magnitude in the range of about 35 volts to about 45 volts, and a negative pulse having a peak magnitude in the range of about 35 volts to about 45 volts.

19. A method of operating a drop emitting generator having a pump chamber and a transducer, comprising:

causing melted solid ink to flow into the pump chamber; and applying to the transducer during a fire interval a drop firing waveform that includes in sequence a first negative pulse, a positive pulse and a second negative pulse, wherein the first negative pulse has a duration that is less than a duration of the positive pulse.

20. A method of operating a drop emitting generator having a pump chamber and a transducer, comprising:

causing melted solid ink to flow into the pump chamber; and applying to the transducer during a fire interval a drop firing waveform that includes in sequence a first negative pulse, a positive pulse and a second negative pulse, wherein the first negative pulse has a generally triangular shape.

21. A method of operating a drop emitting generator having a pump chamber and a transducer, comprising:

causing melted solid ink to flow into the pump chamber; and applying to the transducer during a fire interval a drop firing waveform that includes in sequence a first negative pulse, a positive pulse and a second negative pulse, wherein the first negative pulse has a peak magnitude that is less than about 30 volts.

22. A method of operating a drop emitting generator having a pump chamber and a transducer, comprising:

causing melted solid ink to flow into the pump chamber; and applying to the transducer during a fire interval a drop firing waveform that includes in sequence a first negative pulse, a positive pulse and a second negative pulse, wherein the drop firing interval is no greater than about 56 microseconds.

* * * * *